US009366996B2

(12) United States Patent
Harada et al.

(10) Patent No.: US 9,366,996 B2
(45) Date of Patent: Jun. 14, 2016

(54) SEALING STRUCTURE, DEVELOPING DEVICE, CLEANING DEVICE, PROCESS UNIT, AND IMAGE FORMING APPARATUS

(71) Applicants: Akinori Harada, Osaka (JP); Tomohiro Kubota, Osaka (JP); Hiroshi Fujiwara, Osaka (JP)

(72) Inventors: Akinori Harada, Osaka (JP); Tomohiro Kubota, Osaka (JP); Hiroshi Fujiwara, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/622,244

(22) Filed: Feb. 13, 2015

(65) Prior Publication Data

US 2015/0234324 A1 Aug. 20, 2015

(30) Foreign Application Priority Data

Feb. 18, 2014 (JP) ..... 2014-028664
Apr. 10, 2014 (JP) ..... 2014-081183

(51) Int. Cl.
*G03G 15/08* (2006.01)

(52) U.S. Cl.
CPC ..... *G03G 15/0898* (2013.01); *G03G 15/0812* (2013.01)

(58) Field of Classification Search
CPC ..... G03G 21/0011; G03G 21/007; G03G 15/0898; G03G 15/0817; G03G 21/0029
USPC ..... 399/102
See application file for complete search history.

(56) References Cited

U.S. PATENT DOCUMENTS

| | | | | |
|---|---|---|---|---|
| 5,212,521 | A | 5/1993 | Ogawa et al. | |
| 2005/0180774 | A1 | 8/2005 | Ohgoshi et al. | |
| 2007/0059031 | A1* | 3/2007 | Mori | G03G 15/0817 399/103 |
| 2007/0237540 | A1* | 10/2007 | Ibaraki | G03G 15/0898 399/103 |
| 2009/0110430 | A1 | 4/2009 | Kubota et al. | |
| 2010/0092206 | A1* | 4/2010 | Matsushita | G03G 15/0817 399/103 |
| 2010/0150603 | A1 | 6/2010 | Sakamoto et al. | |
| 2013/0236217 | A1* | 9/2013 | Nagatomo | G03G 9/08 399/281 |
| 2013/0287431 | A1* | 10/2013 | Fukamachi | G03G 15/0898 399/103 |
| 2013/0315643 | A1* | 11/2013 | Wakayama | G03G 21/0011 399/350 |
| 2014/0153958 | A1* | 6/2014 | Ogata | G03G 15/0817 399/103 |

FOREIGN PATENT DOCUMENTS

| | | |
|---|---|---|
| JP | 2000-075656 | 3/2000 |
| JP | 2003098928 | 4/2003 |
| JP | 2007-011417 | 1/2007 |
| JP | 2007271735 | 10/2007 |
| JP | 2010-066386 | 3/2010 |
| JP | 2010-091958 | 4/2010 |

* cited by examiner

*Primary Examiner* — Walter L Lindsay, Jr.
*Assistant Examiner* — Frederick Wenderoth
(74) *Attorney, Agent, or Firm* — Duft Bornsen & Fettig LLP

(57) ABSTRACT

A sealing structure includes a housing to accommodate powder, a powder roller having a surface to bear and convey the powder, and an entrance seal disposed between the powder roller and the housing to allow powder remaining on a circumferential surface of the powder roller to enter the housing. A pair of left and right edge seals is provided in a circumferential direction of the powder roller to overlap with outer circumferential surfaces of both ends of the entrance seal, respectively. Both ends of the entrance seal include powder damming sections extended from both ends thereof along the pair of left and right edge seals, respectively. A pair of inner edges of the respective powder damming sections is each sandwiched between a corresponding one of the pair of left and right edge seals and the powder roller while substantially symmetrically inclining from the rotation direction of the powder roller.

22 Claims, 9 Drawing Sheets

FIG. 10

| NO. | RUNNING DISTANCE OF DEVELOPING ROLLER | | | | |
|---|---|---|---|---|---|
| | 3km | 6km | 9km | 12km | 15km |
| 1 | PRESENCE OF SCATTERING | PRESENCE OF SCATTERING | CONTAMINATION OF INTERIOR | – | – |
| 2 | ABSENCE OF SCATTERING | ABSENCE OF SCATTERING | ABSENCE OF SCATTERING | ABSENCE OF SCATTERING | ABSENCE OF SCATTERING |
| 3 | ABSENCE OF SCATTERING | PRESENCE OF SCATTERING | CONTAMINATION OF INTERIOR | – | – |
| 4 | ABSENCE OF SCATTERING | ABSENCE OF SCATTERING | ABSENCE OF SCATTERING | PRESENCE OF SCATTERING | PRESENCE OF SCATTERING |
| 5 | ABSENCE OF SCATTERING | OCCURRENCE OF ADHESION | – | – | – |

| NO. | TONER DAMMING SECTION | MATERIAL OF EDGE SEAL | PRESSURE OF SEAL N/cm$^2$ | COMMON CONDITIONS |
|---|---|---|---|---|
| 1 | ABSENCE | FELT | 2.0 | ENTRANCE SEAL : PET SHEET HAVING THICKNESS OF ABOUT 0.1 mm<br>TONER : ONE-COMPONENT POLYMERIZED TONER HAVING PARTICLE DIAMETER OF FROM ABOUT 6 μm TO ABOUT 8 μm<br>DEVELOPING ROLLER : ROLLER MADE OF URETHANE RUBBER (ROTATING AT CIRCUMFERENTIAL SPEED OF ABOUT 205 mm/s) |
| 2 | PRESENCE | FELT | 2.0 | |
| 3 | PRESENCE | FELT | 0.5 | |
| 4 | PRESENCE | STRAND PILE | 0.5 | |
| 5 | PRESENCE | STRAND PILE | 5.0 | |

SEALING STRUCTURE, DEVELOPING DEVICE, CLEANING DEVICE, PROCESS UNIT, AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2014-028664, filed on Feb. 18, 2014, and 2014-081183, filed on Apr. 10, 2014 and in the Japan Patent Office, the entire disclosures of which are hereby incorporated by reference herein.

BACKGROUND

1. Technical Field

Embodiments of the present invention relate to a sealing structure, a developing device, a cleaning device, a process unit, and an image forming apparatus.

2. Related Art

In image forming apparatuses, a developing device develops an electrostatic latent image formed on a photoconductive drum by electrostatically affixing electrically charged fine particle toner as developer thereto.

In such a developing device, the toner tends to leak from the developing device, contaminating the interior of the image forming apparatus, and causing defective image formation. This problem immediately becomes apparent upon replacement of the developing device.

In particular, in a developing device that uses a non-magnetic one-component developer, toner is prone to toner leakage around a developing roller. That is, as a grain size of the toner shrinks to meet increasing demand for better image quality, toner tends to drop from a thin layer of toner formed on the developing roller.

To prevent such toner leakage, a number of countermeasures have been proposed. For example, when an entrance seal is brought in sliding contact with a developing roller, ends of the entrance seal are prone to tensile deformation (i.e., curling) causing leakage of toner migrating along the transformed portion. To prevent such curling, the corners of the entrance seal are diagonally cut to form trapezoidal shapes to reduce the area of sliding contact with the developing roller and thus minimize the curling.

Alternatively, multiple inclined toner guiding grooves are formed in the seal to recapture toner about to leak from both ends of a developing roller and return it to a center thereof in its axial direction.

To prevent such toner leakage, both ends of an entrance seal and a pair of edge seals may be separated in a circumferential direction so as not to overlap. Hence, since the entrance seal and the edge seals do not overlap in the circumferential direction, the overlapping steps are accordingly not formed, respectively.

SUMMARY

Accordingly, one aspect of the present invention provides a novel sealing structure that includes a housing to accommodate powder, a powder roller having a powder bearing surface to bear and convey the powder, and an entrance seal disposed between the powder roller and the housing. A pair of left and right edge seals is provided and respective one ends thereof in a circumferential direction of the powder roller overlap with outer circumferential surfaces of both ends of the entrance seal. The pair of left and right edge seals is fixed to the housing at respective one sides thereof while contacting circumferential surfaces of both ends of the powder roller at other sides thereof. Both ends of the entrance seal include powder damming sections extended in a rotation direction of the powder roller from both ends thereof along the pair of left and right edge seals, respectively. Multiple inner edges of the respective powder damming sections are each sandwiched between a corresponding one of the pair of left and right edge seals and the powder roller while substantially symmetrically inclining from the rotation direction of the powder roller.

Another aspect of the present invention provides a novel process unit with a sealing structure that includes a housing to accommodate powder, a powder roller having a powder bearing surface to bear and convey the powder, and an entrance seal disposed between the powder roller and the housing. A pair of left and right edge seals is provided and respective one ends thereof in a circumferential direction of the powder roller overlap with outer circumferential surfaces of both ends of the entrance seal. The pair of left and right edge seals is fixed to the housing at respective one sides thereof while contacting circumferential surfaces of both ends of the powder roller at other sides thereof. Both ends of the entrance seal include powder damming sections extended in a rotation direction of the powder roller from both ends thereof along the pair of left and right edge seals, respectively. Multiple inner edges of the respective powder damming sections are each sandwiched between a corresponding one of the pair of left and right edge seals and the powder roller while substantially symmetrically inclining from the rotation direction of the powder roller.

Yet another aspect of the present invention provides a novel image forming apparatus with a sealing structure that includes a housing to accommodate powder, a powder roller having a powder bearing surface to bear and convey the powder, and an entrance seal disposed between the powder roller and the housing. A pair of left and right edge seals is provided and respective one ends thereof in a circumferential direction of the powder roller overlap with outer circumferential surfaces of both ends of the entrance seal. The pair of left and right edge seals is fixed to the housing at respective one sides thereof while contacting circumferential surfaces of both ends of the powder roller at other sides thereof. Both ends of the entrance seal include powder damming sections extended in a rotation direction of the powder roller from both ends thereof along the pair of left and right edge seals, respectively. Multiple inner edges of the respective powder damming sections are each sandwiched between a corresponding one of the pair of left and right edge seals and the powder roller while substantially symmetrically inclining from the rotation direction of the powder roller.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein:

FIG. 10 is a chart illustrating an exemplary result of a toner leakage test executed in accordance with one embodiment of the present invention.

DETAILED DESCRIPTION

The above-described conventional developing device cannot effectively prevent the toner leakage. That is, since around the developing roller, a lower side entrance seal, left and right side edge seals, and an upper side toner layer regulating member that regulates a thickness of a toner thin layer formed on a circumference of the developing roller are disposed, the ends of the entrance seal overlap with respective one ends of the edge seals in a circumferential direction of the developing roller, respectively. Accordingly, a pair of overlapping steps is formed at both axial ends of the developing roller, and consequently any toner migrating toward the axial ends of the developing roller along a lengthwise direction of the entrance seal tends to leak from the development housing while migrating along the overlapping step as a problem. Further, when both ends of the entrance seal and the pair of edge seals are separated in the circumferential direction from each other so as not to overlap, a pair of gaps from which toner leaks is newly formed in the circumferential direction between both ends of the entrance seal and the pair of edge seals in the circumferential direction, so that toner leaks from the pair of gaps, respectively.

Accordingly, an object of the present invention is to provide a developing device capable of inhibiting toner from leaking from a development housing along an overlapping step by improving a shape of an end of an entrance seal.

Figure 1:
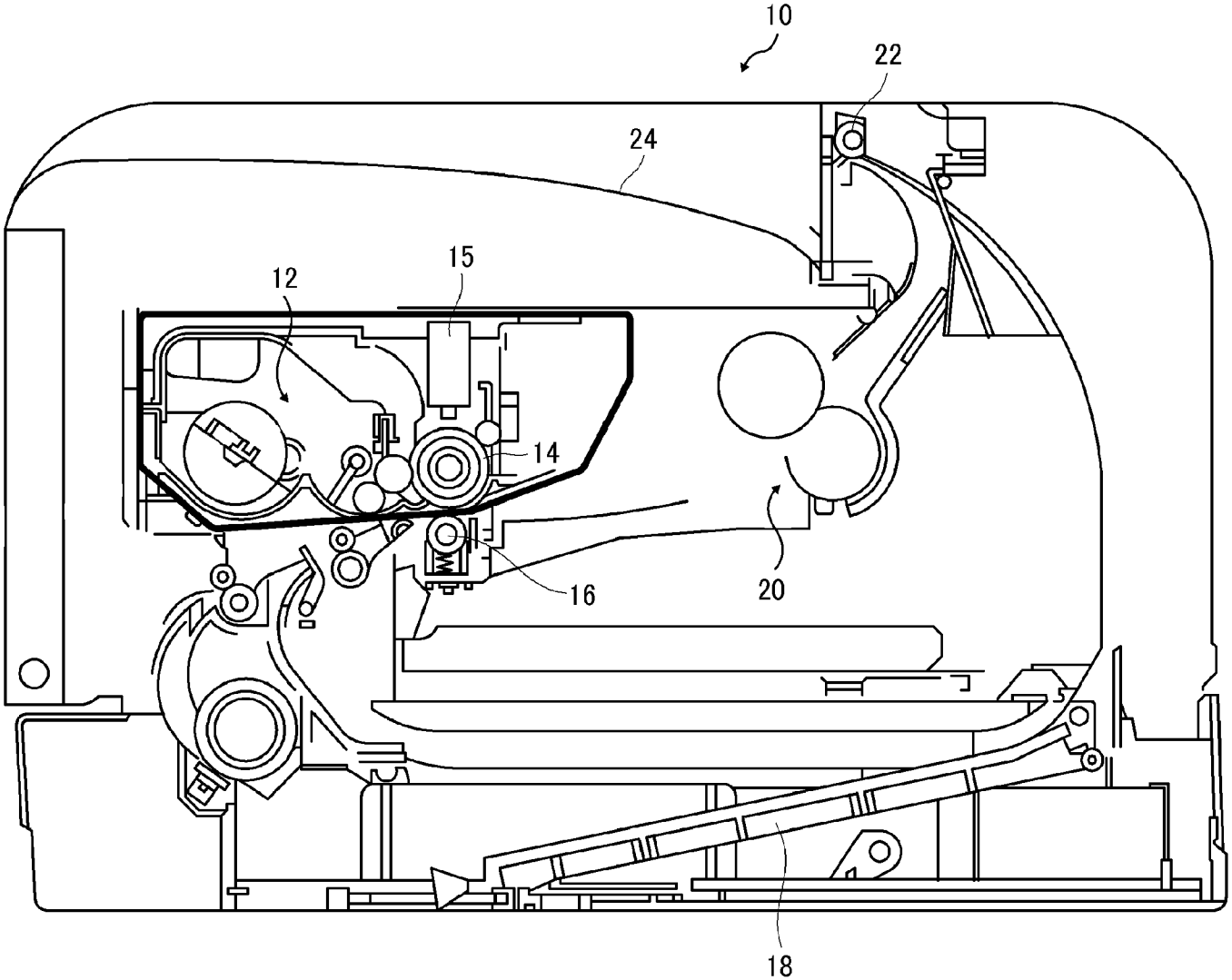
FIG. 1 is a view schematically illustrating an exemplary image forming apparatus according to one embodiment of the present invention.

Referring now to the drawings, wherein like reference numerals designate identical or corresponding parts throughout the several views thereof and in particular to FIG. 1 and applicable drawings, an image forming apparatus, a process unit, a developing device, and a cleaning unit according to various embodiments of the present invention are described.

Initially, an image forming apparatus employing electrography is described herein below with reference to FIG. 1 that schematically illustrates a configuration of the image forming apparatus. Although a monochromatic image forming apparatus is shown for the purpose of simplification, the present invention can be, of course, applied to a color image forming apparatus as well.

Near the center of a frame of the monochromatic image forming apparatus 10, a process unit 12 is disposed. In the process unit 12, as an image bearer a drum-shaped photoconductive drum 14 is disposed.

An exposure unit 15 is disposed just above the photoconductive drum 14. The exposure unit 15 is configured to form a latent image on an outer circumferential surface of the photoconductive drum 14.

Below the process unit 12, a transfer roller 16 is disposed. Below the transfer roller 16, a sheet feeding tray 18 is also disposed. In the sheet feeding tray 18, multiple recording media are stacked and stored therein.

Because a prescribed great amount of voltage is applied to the transfer roller 16, a difference in potential is created between the photoconductive drum 14 and the transfer roller 16, so that a toner image formed on the surface of the photoconductive drum 14 is transferred onto the recording medium.

The recording medium fed from the sheet feeding tray 18 therefrom is led to a fixing device 20 through a gap between the transfer roller 16 and the photoconductive drum 14. By the fixing device 20, a toner image is heated and fixed onto the recording medium. The recording medium with a thermally fixed toner image is then ejected onto a sheet ejection tray 24 by a sheet ejecting device 22 disposed on the top of the image forming apparatus 10.

The process unit is now described herein below more in detail with reference to FIG. 2 that schematically illustrates an overview of the process unit 12 mounted on the image forming apparatus 10. The process unit 12 is configured by unifying the photoconductive drum 14 and the developing unit 30 in a unit.

The process unit 12 is configured to be removable from a body of the image forming apparatus 10. The developing unit 30 can be also separated from the photoconductive drum 14 and is accordingly removable from the process unit 12 alone.

Around the photoconductive drum 14, a cleaning unit 40, an electric charging roller 50, and an exposure unit 15 are sequentially disposed in a rotational direction of the photoconductive drum 14 in this order. The exposure unit 15 has an LED (Light Emitting Diode) head acting as a writing head. The LED head is provided with its longitudinal direction substantially in parallel to an axial direction of the photoconductive drum 14. The LED head is configured by multiple light emitting diodes (LEDs) arranged in a line array state each of which emits a dot light modulated in accordance with image data. The LED head is also configured by a Selfoc lens array (Registered Trademark) as well to image a light beam emitted from the light emitting diode on a surface of a photoconductive drum 14.

A surface of the photoconductive drum 14 is uniformly charged by an electric charging roller 50 with a prescribed polarity of a high potential, and is thereby electrically initialized. As a ray of light L is emitted from the LED head of the exposure unit 15 to such a high voltage charged area, an electrostatic latent image is formed on an outer circumferential surface of the photoconductive drum 14.

The cleaning unit 40 has a cleaning blade 42 acting as a cleaning unit and a toner conveying screw 43 in a cleaner housing 41. The cleaning blade 42 is made of an elastic body such as rubber, etc., having an electrical resistance, for example, from about $10^5$ Ω·cm to about $10^9$ Ω·cm. The cleaning blade 42 is pressed against the photoconductive drums 14 via its tip with it directed in a counter direction to a rotation direction of the photoconductive drum 14 at a given contact pressure.

An electrode, not shown, is attached to the cleaning blade 42 while extending along a longitudinal direction thereof. A power supply circuit, not shown, is connected to the electrode to provide a voltage to the cleaning blade 42.

An electric charge is thus injected into toner that slips through the cleaning blade 42 by application of such a voltage to equalize a polarity of transfer residual toner passing through the cleaning blade 42.

As described later with reference to FIG. 6, an elastic polishing roller 44 is disposed on an upstream side of the cleaning blade 42 in a rotation direction of the photoconductive drum 14 in the cleaner housing 41 provided in the cleaning unit 40.

The developing device is now described more in detail herein below. The developing unit 30 has a vertical type development housing 31 as shown in FIG. 2. In this development housing 31, a first toner conveying screw 32, a partition wall 33, a second toner conveying screw 34, a toner supplying roller 35, and a developing roller 36 are disposed in this order from the top. Above the developing roller 36, a toner layer regulating member 37 is disposed.

To the top of the development housing 31, a toner supplying container 60 storing toner is connected to supply the toner thereto. In the toner supplying container 60, a stirring paddle 61 and a toner conveying screw 62 are disposed to keep fluidity of the toner.

The toner in the toner supplying container 60 is always stirred by the stirring paddle 61 and the toner conveying screw 62. Hence, a prescribed necessary amount of toner can be supplied to a toner supply mouth, not shown, provided in the developing unit 30. This toner supply amount can be controlled based on a driving time period of a body side driving device as described later. For example, when toner liquidity is changed due to a change in temperature humidity environment, the driving time period can be changed in accordance therewith.

Figure 2:
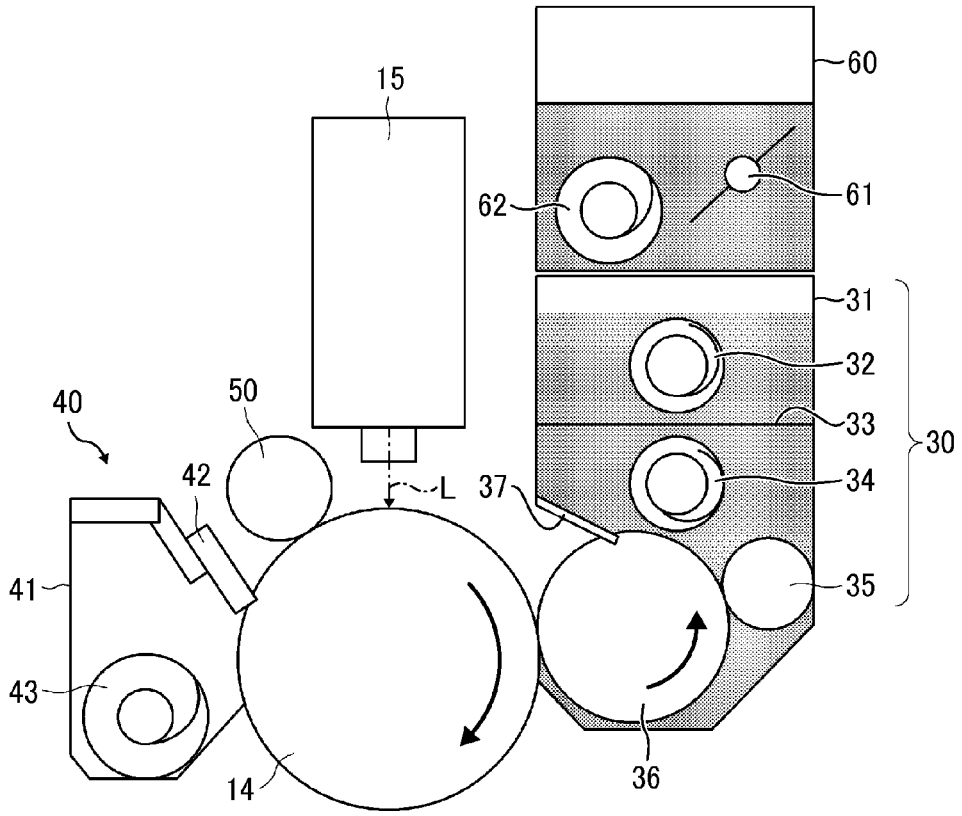
FIG. 2 is a view schematically illustrating an exemplary process unit according to one embodiment of the present invention.
Figure 3:
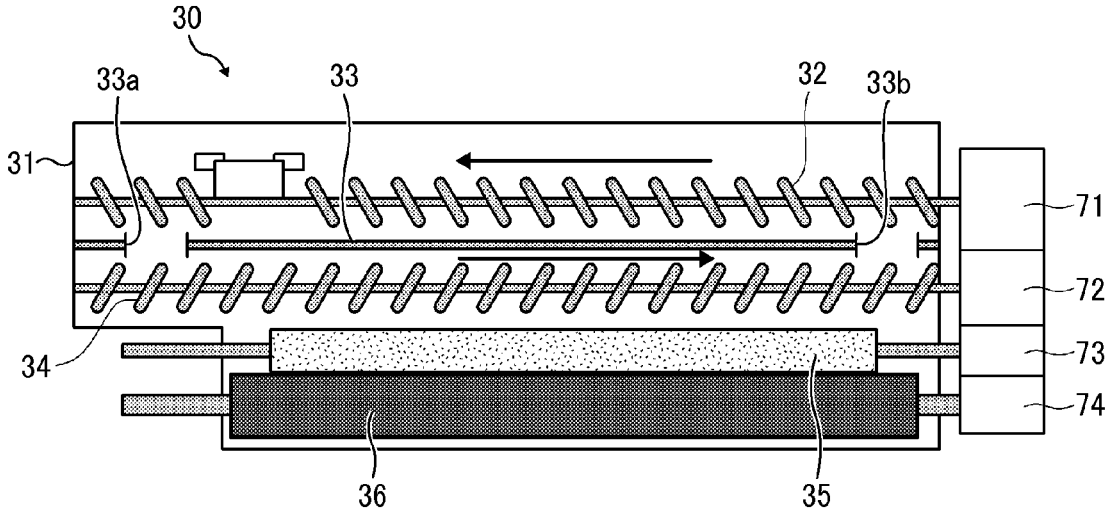
FIG. 3 is a plan view schematically illustrating an exemplary developing device according to one embodiment of the present invention.

FIG. 3 is a perspective view of the developing unit 30 of FIG. 2 when taken from the left side thereof. As shown, the first toner conveying screw 32, the second toner conveying screw 34, the toner supplying roller 35, and the developing roller 36 are disposed in parallel to each other.

To one end of a rotary axis of each of the first and second toner conveying screws 32 and 34 and toner supplying and developing rollers 35 and 36, each of multiple gears 71 to 74 is attached, respectively. On the other hand, in the body of the image forming apparatus, a publicly known driving device, not shown, composed of clutches, couplings, and gears or the like is disposed. Hence, when the respective gears 71 to 74 are detachably connected to the driving device, the first and second toner conveying screws 32 and 34 and toner supplying and developing rollers 35 and 36 can be rotated by the driving device of the body.

The partition wall 33 is positioned between the first toner conveying screw 32 and the second toner conveying screw 34, and includes a pair of openings 33*a* and 33*b* in left and right sides thereof to distribute toner therethrough. The first toner conveying screw 32 and the second toner conveying screw 34 are rotated by multiple gears 71 and 72, respectively, to convey the toner stored therein in an opposite direction to each other.

In this embodiment, the first toner conveying screw 32 conveys toner to the left. By contrast, the second toner conveying screw 34 conveys toner to the right. Hence, the toner circulates within the development housing 31.

A toner conveying speed can be controlled by the toner conveying screws 32 and 34. Specifically, a toner transfer speed proportionally increases to a screw pitch and a number of revolutions of the first and second toner conveying screws 32 and 34. An amount of toner conveyed by the screw per rotation of the screw can be controlled by adjusting a diameter of the screw as well.

A surface of the toner supplying roller 35 is made of polyurethane foam or sponge and the like to be able to bear toner thereon. The developing roller 36 is configured by a cored bar and an electrical conductive polyurethane layer having a predetermined thickness overlying the cored bar. An outer circumference of the toner supplying roller 35 is brought in contact with the developing roller 36 at a prescribed pressure.

The toner supplying roller 35 is also brought in contact with the developing roller 36 while forming a given amount of nip width. The toner supplying roller 35 rotates in a reverse direction to that of the developing roller 36, i.e., counterclockwise in FIG. 2. With this, toner on the toner supplying roller 35 is rubbed against a circumferential surface of the developing roller 36 and is pre-charged within the nip and supplied thereafter.

Figure 4A:
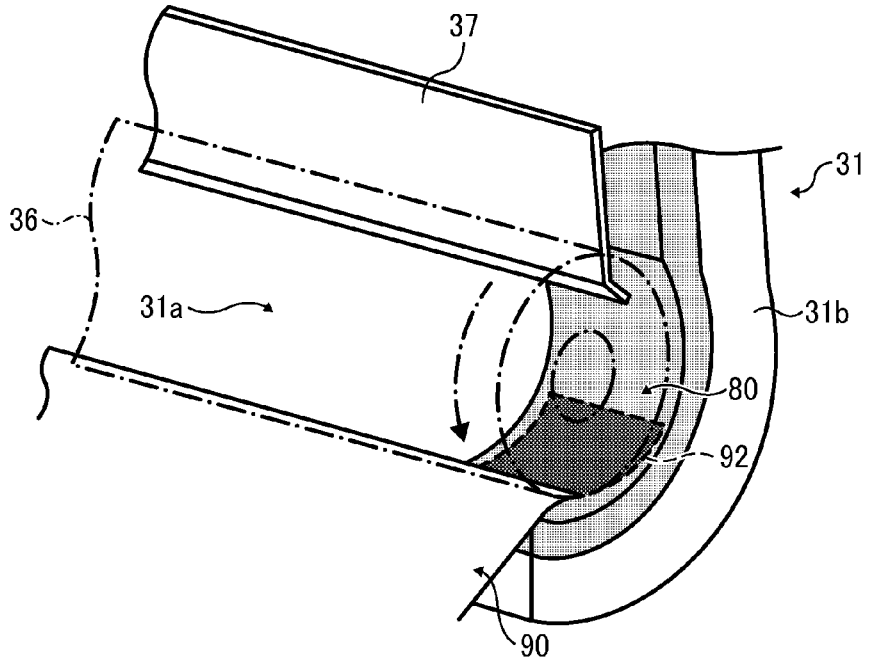
FIG. 4A is a perspective view schematically illustrating an one end of a developing container included in a developing device of an image forming apparatus as a comparative example.
Figure 4B:
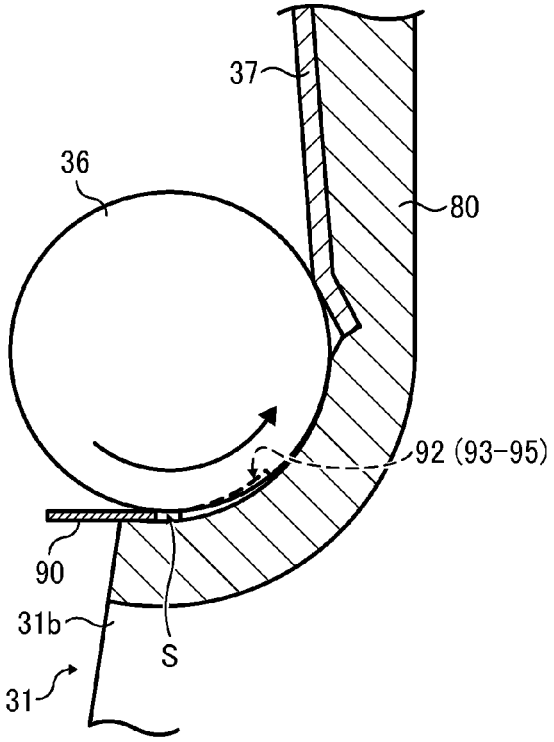
FIG. 4B is a cross-sectional view schematically illustrating the developer container included in the developing device of FIG. 4A.

An amount of toner supplied onto the circumferential surface of the developing roller 36 by the toner supplying roller 35 is regulated by the toner layer regulating member 37 shown in FIGS. 4A and 4B, so that a thickness of a layer of toner adhering to the circumferential surface of the developing roller 36 can be uniform. After that, an amount of toner in proportion to a surface potential of the photoconductive drum 14 travels from the developing roller 36 onto the surface of the photoconductive drum 14. With this, the electrostatic latent image is rendered visible as a toner image on the surface of the photoconductive drum 14. The toner image is then transferred by the transfer device, not shown, onto a recording medium.

As described above, although the toner moved to the photoconductive drum 14 remains thereon as transfer residual toner, the transfer residual toner is removed by the cleaning unit 40 as shown in FIG. 2. After that, the transfer residual toner removed in this way is collected into a waste toner accommodating container, not shown, installed within the image forming apparatus 10.

A structure of one end of the developing roller and surroundings thereof included in a development housing is described. As shown in FIG. 4A, a laterally long rectangular-shaped opening 31*a* is formed in the development housing 31, in which the developing roller 36 is rotatably disposed. At widthwise both ends of the development housing 31, at which both sides of the above-described opening are located, respectively, a partially cylindrical section 31*b* is formed to rotatably accommodate both ends of the developing roller 36.

As shown in FIGS. 4A and 4B, to an inner circumferential surface of the partially cylindrical section 31*b*, an edge seal 80

(shown by thin shading in FIG. 4A) is adhered to prevent toner leakage. Here, the edge seal 80 is made of felt or pile fabrics or the like. When the pile fabrics are used, to preferably seal an uneven surface of the developing roller 36, a pile length thereof is desirably about 1.5 mm or more.

The edge seal 80 has a curved surface along a shape of the developing roller 36. The end of the seal 80 is partially brought in sliding contact with the developing roller 36. Hence, when the development housing 31 is assembled into the developing roller 36, left and right ends of the developing roller 36 are pressed against the edge seals 80, respectively. Hence, a gap between the developing roller 36 and the development housing 31 is sealed.

To an upper edge of the opening 31*a* of the development housing 31, for example, a toner layer regulating member 37 produced by molding stainless steel in an L-shape at its tip having a thickness about 0.1 mm is attached. To the toner layer regulating member 37, a prescribed amount of voltage is applied to generate a bias voltage of about −100 V, for example, against the developing roller 36. Hence, as the tip of the toner layer regulating member 37 contacts a circumferential surface of the developing roller 36, a thin toner layer is formed on a circumferential surface of the developing roller 36. Both ends of the toner layer regulating member 37 extend, respectively, over the edge of the edge seals 80.

Specifically, the edge seal 80 also partially contacts the toner layer regulating member 37 as well. Hence, when the developing roller 36 is assembled into the development housing 31, the toner layer regulating member 37 is pressed by the developing roller 36, so that both ends of the toner layer regulating member 37 are pressed against the edge seals 80 as well. In this way, a gap between the toner layer regulating member 37 and the development housing 31 is also sealed.

Near both ends of the developing roller 36 in its axial direction, a pair of spacers, not shown, is provided, respectively. As the pair of spacers is brought in contact with the surface of the photoconductive drum 14, a distance (i.e., the development gap) in the development area of the developing roller 36 between the surface of the partially cylindrical section and the photoconductive drum 14 is kept constant.

The above-described edge seals 80 are disposed inside the spacers in the axial direction, respectively. Hence, with such edge seals 80, leakage of toner from both ends of the opening 31*a* of the development housing 31 in its longitudinal direction is prevented as well.

On the other hand, in the lower margin of the opening 31*a* of the development housing 31 extended in the longitudinal direction, to prevent the toner leakage from the lower margin, the entrance seal 90 is disposed. That is, the entrance seal 90 is disposed over the entire width of the lower edge of the opening 31*a*. Both ends of the entrance seal 90 are sandwiched between the edge seals 80 and the toner-bearing surfaces of the circumferential surface of the developing roller 36, respectively.

The entrance seal 90 can be made of, for instance, conductive PTFE (Polytetrafluoroethylene) or PET (Polyethylene terephthalate) with a given volume resistivity. The entrance seal 90 has the same potential as the developing roller 36. The toner borne on the developing roller 36 is collected into the development housing 31 while an electric charge of the toner is removed by the entrance seal 90.

FIG. 4B is a cross-sectional view typically illustrating one end of the developing unit 30. As shown there, in the past, there is a wedge shaped small gap S between the edge seal 80 and the developing roller 36 adjacent to an end of the entrance seal 90. As a result, toner leaks out toward both ends of the development housing 31 through the gaps S thereby raising a problem.

A size of the gap S can be minimized by thinning the entrance seal 90. However, when it is thinned, the entrance seal 90 easily waves and deforms (i.e., curling as described earlier) due to contacting the developing roller 36. When the entrance seal 90 waves and deforms, the toner tends to leak along deformed winkle generated in this way. Accordingly, it is conventionally considered that the conventional entrance seal 90 at least needs a thickness of approximately 0.15 mm.

However, it is found that even the thickness is about 0.15 mm, for example, a small gap S is yet formed by the thickness thereof as shown in FIG. 4B, so that the toner leaks again from the gap S. Then, in this embodiment, a thickness of the entrance seal 90 is set to about 0.1 mm or less. However, when the thickness of the entrance seal 90 is set to less than 0.05 mm, the curling tends to occur. Consequently, the thickness of the entrance seal 90 is desirably from about 0.05 mm or more to about 0.1 mm or less.

Also, the entrance seal 90 of the developing device according to each of embodiments of the present invention has a toner damming section 93, 94, or 95 to fill a wedge-shaped gap S as described later. FIG. 4A illustrates a comparative example, in which a rectangular-shaped toner damming section 92 is formed extending in a circumferential direction as shown by a dark shading. A similar sealing structure is disclosed in Japanese Patent Application Laid Open No. 2007-11417 in claim 24 and columns 0158 and 0160. In FIG. 4B, the toner damming section 92 (also 93 to 95) is shown by a dashed line. The toner damming section 92 (also 93 to 95) has the same thickness as the entrance seal 90 and is integrally formed with the entrance seal 90.

Specifically, at each of both ends of the entrance seal 90, the toner damming section 92 (also 93 to 95) extends by a prescribed length in a circumferential direction of the developing roller 36 (i.e., a direction of rotation of the developing roller 36) and includes a free end at its downstream end in the rotational direction. Hence, by filling the wedge-shaped gap S of FIG. 4B with the toner damming section 92 (also 93 to 95), toner leakage can be prevented.

Figure 4C:
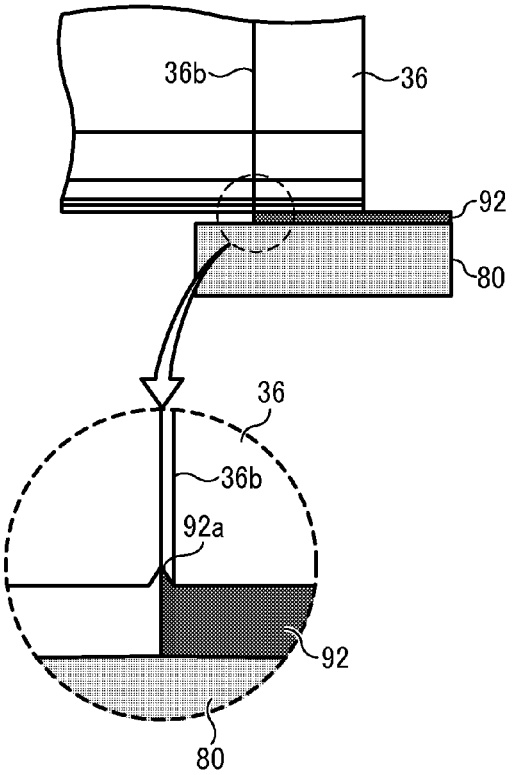
FIG. 4C is an enlarged view schematically illustrating a portion of the developer container included in the developing device of FIG. 4A.

However, as shown by the comparative example of the toner damming section 92, when the toner damming section is rectangularly extended in the circumferential direction, a protrusion 92*a* such as a burr, etc., protruding from an edge of the toner damming section 92 as shown in FIG. 4C tends to generate (i.e., draw) a linear groove 36*b* on a circumferential surface of the developing roller 36 in the circumferential direction. When the linear groove 36*b* is formed in this way, the toner is prone to leaking through the linear groove 36*b*.

Figure 5A:
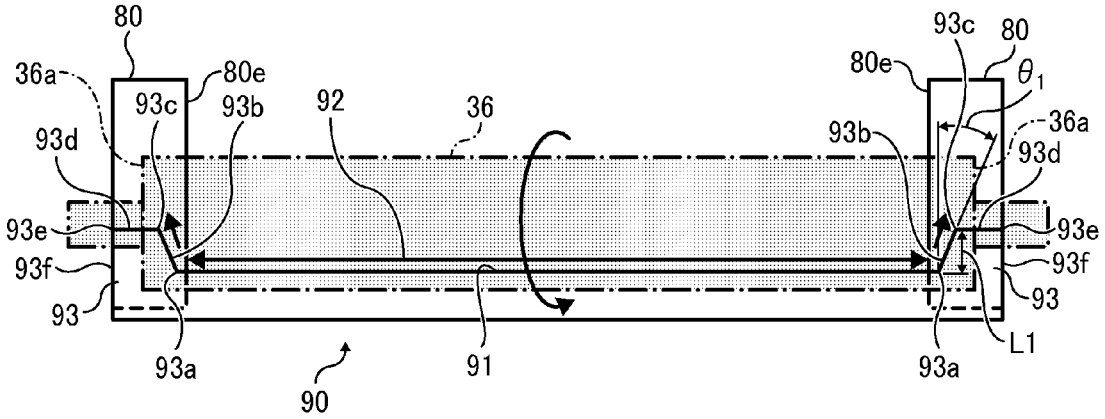
FIG. 5A is a plan view schematically illustrating an exemplary portion of a seal attached to a developing device according to a first embodiment of the present invention.
Figure 5B:
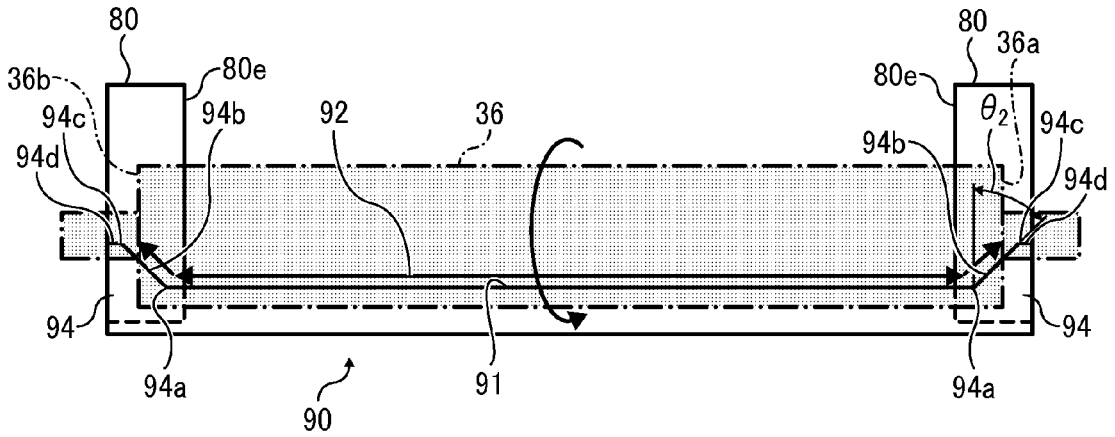
FIG. 5B is a plan view schematically illustrating an exemplary portion of a seal attached to a developing device according to a second embodiment of the present invention.
Figure 5C:
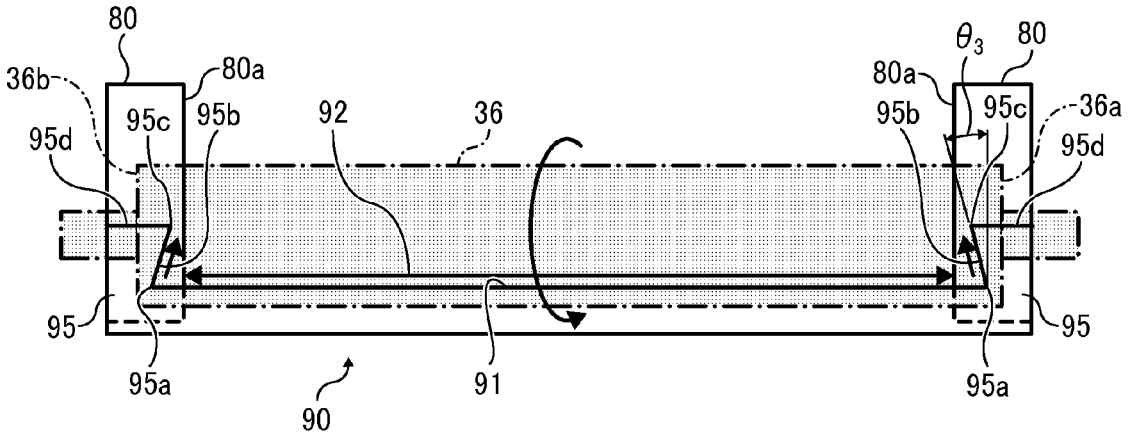
FIG. 5C is a plan view schematically illustrating an exemplary portion of a seal attached to a developing device according to a third embodiment of the present invention.

Then, according to this embodiment of the present invention, as shown in FIGS. 5A to 5C, to solve such a problem, each of the toner damming sections 93, 94, and 95 is not simply rectangularly extended in the circumferential direction, but is extended with its inner edge inclining either outwardly or inwardly (i.e., inclining inner edges 93*b*, 94*b*, and 95*b*). In that way, because the circumferential surface of the developing roller 36 is not locally scraped off by each of the inclining inner edges 93*b*, 94*b*, and 95*b* of the respective toner damming sections 93, 94, and 95, the linear groove 36*b* is not produced in the circumferential direction thereof.

Specifically, since each of the inclining inner edges 93*b*, 94*b*, and 95*b* of the toner damming sections 93 to 95 inclines, a scratch is only shallow and wide even when a projection such as a burr, etc., formed in each of the inclining inner edges 93*b*, 94*b*, and 95*b* scratches the circumferential surface of the developing roller 36. Also, even when the developing roller 36 wears as a result, the nip between the developing roller 36 and each of the toner damming sections 93 to 95 can prevent toner leakage.

Here, the developing roller 36 rotates with its lower circumferential surface contacting the entrance seal 90. Residual toner generally adheres to a circumferential surface of the developing roller 36. The residual toner easily falls off from the circumferential surface of the developing roller 36. Therefore, the entrance seal 90 includes a function to seal the development housing 31 not to leak toner outside therefrom and that to allow the residual toner adhering to the circumferential surface of the developing roller 36 to smoothly enter the development housing 31 as the developing roller 36 rotates as well.

The entrance seal is now described more in detail. FIGS. 5A to 5C illustrate multiple shapes of the entrance seal 90 improved by employing three types of toner damming sections 93 to 95 (i.e., first to third embodiments), respectively. Here, FIGS. 5A to 5C are views taken from above the entrance seal 90 of FIG. 4B (i.e., a side of the photoconductive drum 14). As shown, each of shapes of the three kinds of the entrance seals 90 is substantially symmetrical. In the drawing, however, the development housing 31 and the toner layer regulating member 37 are not shown. The developing roller 36 is illustrated by applying thin ink, while an outline line thereof is indicated by one point dashed line.

A front side of a circumferential surface of the developing roller 36 in the drawing (i.e., an upper side thereof) rotates downwardly as shown by an arrow. By contrast, the other side of a circumferential surface of the developing roller 36 in the drawing (i.e., a lower side thereof) rotates upwardly as shown by an arrow. Hence, as shown in FIG. 4B, the developing roller 36 enters the development housing 31 with its a lower side of the circumferential surface contacting the entrance seal 90.

As shown in FIGS. 5A to 5C, the toner damming sections 93 to 95 are formed extending from both ends of the entrance seal 90 in the rotation direction of the developing roller 36 (i.e., a circumferential direction thereof). The inclining inner edges 93*b*, 94*b*, and 95*b* of the toner damming sections 93 to 95 incline by angles θ1, θ2, and θ3 to a rotation direction of the developing roller 36 (i.e., a circumferential direction thereof), respectively.

Specifically, in a first embodiment of FIG. 5A, a pair of inclining inner edges 93*b* of the toner damming section 93 each inclines from a direction of rotation of the developing roller 36 by about an angle θ1. In a second embodiment of FIG. 5B, a pair of inclining inner edges 94*b* of the toner damming sections 94 each outwardly inclines from a direction of rotation of the developing roller 36 by an angle of about θ2. In a third embodiment of FIG. 5C, a pair of inclining inner edges 95*b* of the toner damming sections 95 each inwardly inclines from the direction of rotation of the developing roller 36 by an angle of about θ3. As shown, these three types of the entrance seals 90 of FIGS. 5A to 5C have a common shape with each other except for that of both ends of those.

Now, various embodiments of entrance seals are described herein below.

First of all, a first embodiment is described with reference to FIG. 5A. The toner damming sections 93 each has a trapezoid-shape as a whole at both ends of the entrance seal 90. The toner damming sections 93 extend from both ends of the entrance seal 90 in the rotation direction (i.e., a circumferential direction) of the developing roller 36 each by a prescribed length and is brought in contact with circumferential surfaces of both ends of the developing roller 36. Each of the toner damming sections 93 is sandwiched between the circumferential surface of the end of the developing roller 36 and the edge seal 80 entirely.

Each of the inclining inner edges 93*b* of the entrance seal 90 extends linearly between a corner (a first inflection point) 93*a* and another corner (a second inflection point) 93*c* while inclining outwardly by an angle of about θ1. A leading edge 93*d* of the toner damming section 93 extends linearly between the corners 93*c* and 93*e* in an axial direction of the developing roller 36. An outer edge 93*f* of the toner damming section 93 extends to the circumferential direction of the developing roller 36. A longitudinal edge 91 of the entrance seal 90 intersects with the inclining inner edges 93*b* of the toner damming sections 93 at respective corners 93*a*. The corner 93*a* has an obtuse angle of about (90°+θ1).

When the entrance seal 90 simply has a horizontally rectangular-shape as a conventional seal in which the toner damming section 93 is not included, toner leaks out from the gap S. As also already described, when the toner damming section 93 simply extends rectangularly in the circumferential direction as the toner damming section 92 of FIG. 4A, the linear groove 36*b* is formed on a circumferential direction of the developing roller 36 so that toner is prone to leaking again. However, according to this embodiment of the present invention, as the toner damming section 93 forms a trapezoid-shape, the gap S is filled with the toner damming section 93 as shown by the dashed line in FIG. 4B, generation of the linear groove 36*b* in the circumferential direction of the developing roller 36, and accordingly, toner leakage can be prevented at the same time.

Although an overlapping step is created by the leading edge 93*d* and the inclining inner edge 93*b* of the toner damming section 93, since there exists the nip at the overlapping step between the developing roller 36 and the edge seal 80, toner leaking from both ends of the entrance seal 90 can be prevented by the nip. Accordingly, effectiveness of filling the gap S is substantially the same in the toner damming sections 94 and 95 (FIGS. 5B and 5C) of the second and third embodiments.

To prevent toner leakage as a goal of the present invention, usage of the nip between the edge seal 80 and the developing roller 36 is needed as mentioned earlier. Accordingly, the corner 93*a* at least needs to be placed between the inner edge 80*e* of the edge seal 80 and the end 36*a* of a toner bearing surface of the developing roller 36.

Also, to maintain a good toner sealing performance, the toner damming section 93 needs a length L1 of about 1.0 mm or more in a circumferential direction. Here, the length L1 in the circumferential direction represents a distance in the circumferential direction from a corner (a first inflection point) 93*a* to the other corner (a second inflection point) 93*c*. When the length L1 is less than about 1.0 mm, sufficient toner damming function cannot be obtained thereby leaking toner. That is, by rendering the length L1 to be about mm or more, the toner damming function can be sufficiently obtained. The length L1 in the circumferential direction is substantially the same in the embodiments of FIGS. 5B and 5C described later.

The corners 93*a*, 93*c*, and 93*e* of the toner damming section 93 are desirably chamfered or rounded. That is, with such a chamfered or rounded corner, a good toner sealing performance is also maintained as well. The above-described toner sealing performance obtained when the corner is either chamfered or rounded can be effectively maintained equivalently in the embodiments described later with reference to FIGS. 5B and 5C as well.

In FIG. 5A, a toner moving path is indicated by an arrow. As shown, the toner travels outwardly along the longitudinal edge 91 of the entrance seal 90. However, since the inclining inner edge 93*b* of the toner damming section 93 extends toward an outside from the end of the longitudinal edge 91, the toner is suppressed to flow at the corner 93*a*, that is, the first inflection point.

In this first embodiment, since the inclining inner edge 93*b* is longer than the rectangular-shaped toner damming section 92 of FIG. 4A due to inclination of the inclining inner edge 93*b*, the toner is more suppressed to flow by a degree corresponding to an increased length. In addition, at this section, the nip is formed between the developing roller 36 and the edge seal 80.

Therefore, the toner is substantially inhibited to flow. To form the above-described nip at the position, at least the corner 93*a* needs to be placed between the inner edge 80*e* of the edge seal 80 and the end 36*a* of the developing roller 36.

Hence, with such a configuration, even when the toner attempts to continuously flow along the inclining inner edge 93*b* in the rotation direction of the developing roller 36, since the nip is formed by the developing roller 36 and the edge seal 80 at this section, the toner is substantially prevented to further flow.

Now, a second embodiment of an entrance seal is herein below described. That is, a second embodiment of the an entrance seal 90 is described with reference to FIG. 5B. As shown, each of toner damming sections 94 located at both ends of the entrance seal 90 is similarly formed to the first embodiment by including a trapezoid-shape as a whole. In this second embodiment, the inclining inner edge 94*b* of the toner damming section 94 is inclined to an outside in the axial direction of the developing roller 36 by an angle of about θ2 (θ1<θ2) while placing the leading edge 94*d* beyond the end 36*a* of the developing roller 36. Therefore, an angle made by the longitudinal edge 91 and the inclining inner edge 94*b* of the entrance seal 90 is obtuse with an angle of about (90°+θ2).

Since the leading edge 94*d* does not overlap with the toner bearing section of the developing roller 36, the developing roller 36 can prevent wearing at this section. Here, effectiveness of the wearing prevention does not change even when the corner 94*c* as a second inflection point coincides with the end 36*a* of the toner-bearing section of the developing roller 36.

In this second embodiment, since the inclining inner edge 94*b* inclines by an angle of about θ2 (θ1<θ2), the inclining inner edge 94*b* becomes longer than in the first embodiment. Accordingly, the toner is suppressed to flow by a degree corresponding to such an amount of length increased. In addition, at this section, the nip is formed between the developing roller 36 and the edge seal 80 again. Therefore, the toner is practically inhibited to flow. To form the above-described nip, at least the corner 94*a* needs to be placed between the inner edge 80*e* of the edge seal 80 and the end 36*a* of the developing roller 36.

Now, a third embodiment of an entrance seal is herein below described in detail. A third embodiment of the entrance seal 90 is described with reference to FIG. 5C. As shown, each of the toner damming sections 95 provided at both ends of the entrance seal 90 has a trapezoid shape when viewed as a whole. The toner damming sections 95 are obtained by reversing those of first and second embodiments upside down. In this third embodiment, the inner edge 94*b* inclines inwardly while widening a leading edge 95*d*. An angle made by the longitudinal edge 91 and the inclining inner edge 95*b* as a third damming section of the entrance seal 90 is sharp with an angle of about (90°−θ3).

However, the corner 95*c* as the second inflection point is located outside the inner edge 80*e* of the edge seal 80. That is, since it impacts on image formation when going beyond the inner edge 80*e*, the corner 95*c* does not go beyond the inner edge 80*e* of the corner 95*c*.

FIG. 5C indicates a toner transfer pathway with an arrow. As shown, the toner moves outwardly along the longitudinal edge 91 of the entrance seal 90. However, the inclining inner edge 95*b* of the toner damming section 95 extends inwardly from the end of the longitudinal edge 91, the toner is more strictly suppressed to flow at a sharp corner 95*a*, specifically the first inflection point, than in the first embodiment.

In addition to such a configuration, since a nip is formed by the developing roller 36 and the edge seal 80 at this section, the toner is substantially prevented to further flow along the inclining inner edge 95*b* even when the toner attempts to continuously flow.

Now, one embodiment in which the present invention is applied to a cleaning unit is herein below described. That is, FIG. 6 illustrates one embodiment of the present invention applied to a cleaning unit. As shown, this cleaning system employs an elastic polishing roller 44.

Such an elastic polishing roller 44 corresponds to the above-described developing roller 36 of the developing unit 30. As shown in FIGS. 6 and 7, beneath the elastic polishing roller 44, an edge seal 180 and an entrance seal 190 are disposed as well.

Figure 6:
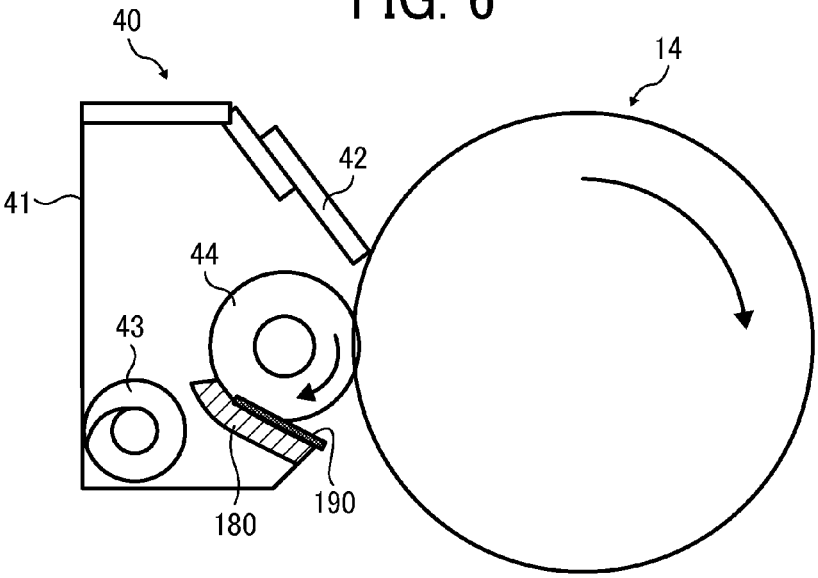
FIG. 6 is a cross-sectional view illustrating an exemplary cleaning unit to which another embodiment of the present invention is applied.

Accordingly, also in a conventional cleaning unit 40 of FIG. 6, since an overlapping step is formed by the edge seal 180 and the entrance seal 190, a problem of the above-described toner leakage is similarly raised again.

The elastic polishing roller 44 is brought in sliding contact with a photoconductive drum 14 to scrape off degraded toner previously supplied over the entire circumferential surface of the photoconductive drum 14 for forced toner consumption in a toner refreshing mode. At the same time, the elastic polishing roller 44 also scrapes off toner filming adhering to the surface of the photoconductive drum 14 over time.

When the toner refreshing mode is executed when a process, in which an electrostatic latent image formed on the photoconductive drum 14 is rendered visible as a toner image, does not run. The degraded toner is taken into the cleaner housing 41 by a cleaning blade 42 acting as a cleaning unit and the elastic polishing roller 44 as it rotates. The toner taken in in this way is conveyed to a waste toner accommodating container by a toner conveying screw 43.

Figure 7A:
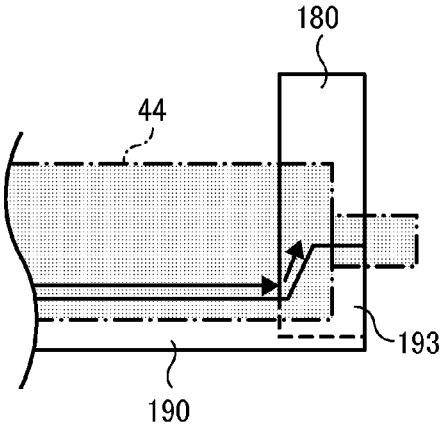
FIGS. 7A to 7C are plan views partially illustrating exemplary sealing sections attached to the cleaning unit of FIG. 6 according to the other embodiments of the present invention.
Figure 7B:
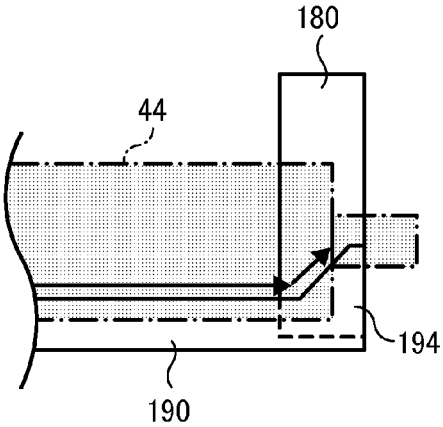
Figure 7C:
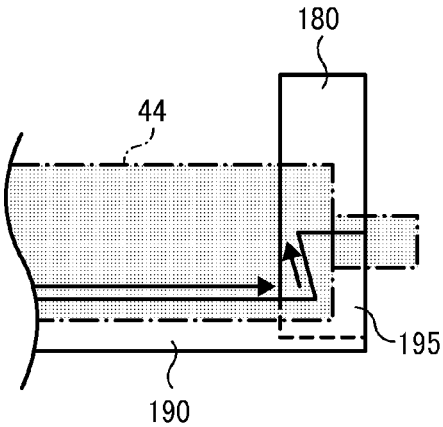

As shown in FIGS. 7A to 7C, each of toner damming sections 193 and 195 extends from an edge of the entrance seal 190 in a rotation direction (i.e., a circumferential direction) of the elastic polishing roller 44. In FIG. 7, although only one end of the entrance seal 190 is shown, the other side has the same shape as well as in the earlier described embodiments (i.e., a left and right substantially symmetrical shape).

Multiple arrows shown FIGS. 7A to 7C each indicate a flow of degraded toner. The degraded toner is inhibited or blocked by each of toner damming sections 193 to 195 to flow. A function and a shape of each of the toner damming sections 193 to 195 is substantially the same as the above-described toner damming sections 93 to 95 of the entrance seal 90.

Figure 8:
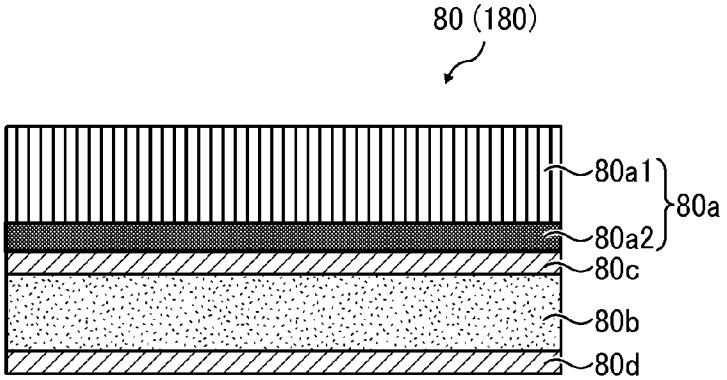
FIG. 8 is a cross-sectional view schematically illustrating an exemplary edge seal that employs pile fabrics attached to the cleaning unit to which one embodiment of the present invention is applied.

Now, an exemplary configuration of the edge seal is herein below described. That is, a configuration of an edge seal 80 also available in the early described respective embodiments is herein below described. The edge seal 80 can be also used as an edge seal 180 of the cleaning unit beside that of the developing device. Specifically, as shown in FIG. 8, the edge seal 80 is configured in a laminate state. More specifically, the edge seal 80 is composed of at least two layers including a pile fabric 80*a* and a foamed polyurethane layer 80*b* disposed as an elastic body under the pile fabric 80*a*.

The pile fabric 80*a* and the foamed polyurethane layer 80*b* are pasted together via a double-sided tape 80*c*. Also, the foamed polyurethane layer 80*b* is stuck on an inner circumferential surface of the partially cylindrical section 31*b* through a double-sided tape 80*d*. However, instead of the double-sided tapes 80*c* and 80*d*, any other gluing system, such as adhering by using adhesives, etc., can be used.

A commonly used pile fabric can be used as the pile fabric 80*a*. The pile fabric 80*a* is configured by a strand pile section 80*a*1 and a base 80*a*2 to which a base end of the strand pile section 80*a*1 is secured. The strand pile section 80*a*1 can be configured by either Teflon (Registered Trademark) yarn or nylon yarn and the like.

To appropriately seal an uneven surface of the developing roller 36, a pile length of the strand pile section 80*a*1 is desirably from about 0.6 mm to about 3.0 mm. When the pile length is below about 0.6 mm, rigidity of a pile is lost, and accordingly the strand pile section 80*a*1 does not effectively fit into the unevenness on the circumferential surface of the developing roller 36. By contrast, when the pile length is about mm or more, a gap tends to appear between piles. Therefore, when the pile length is outside a range of from about 0.6 mm to about 3.0 mm, the toner is prone to leaking. By contrast, when the pile length falls within the range of from about 0.6 mm to about 3.0 mm, the toner rarely leaks.

Figure 9A:
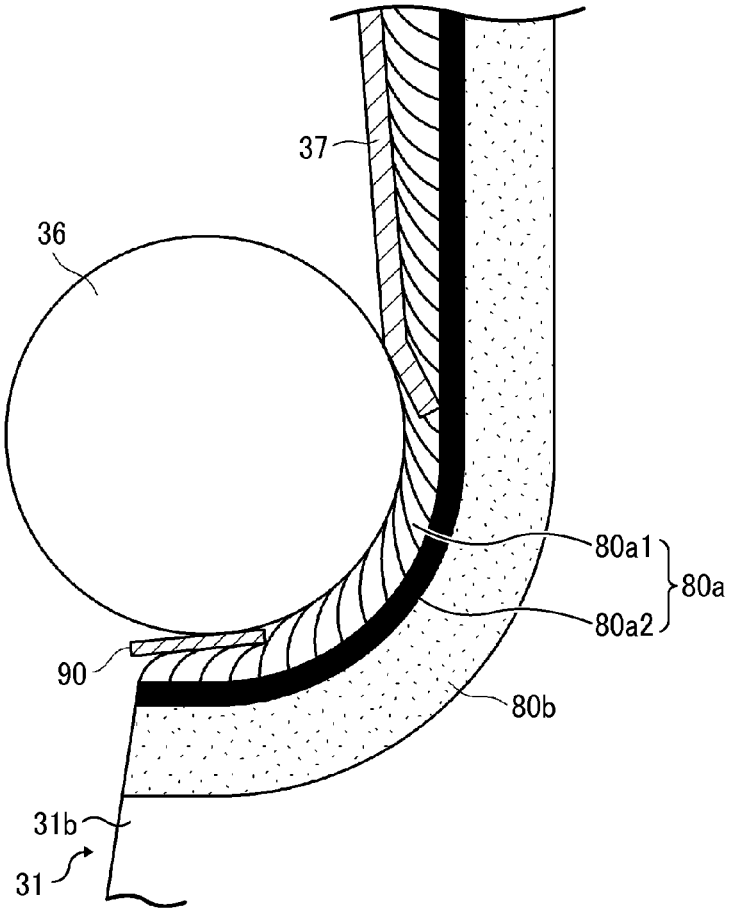
FIG. 9A is a cross-sectional view partially illustrating an exemplary developer container with the edge seal made of pile fabrics, to which one embodiment of the present invention is applied.
Figure 9B:
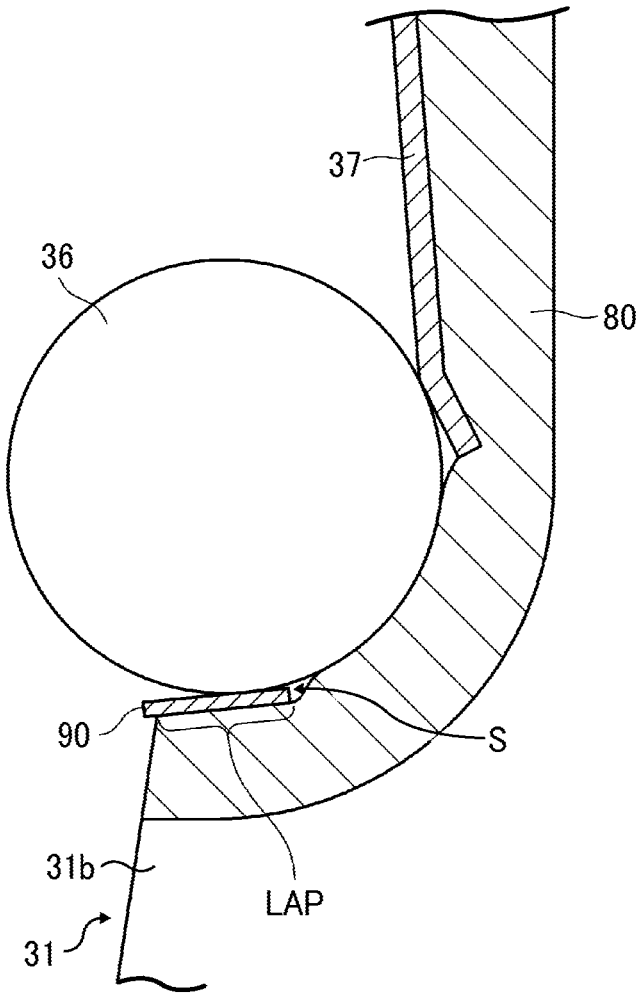
FIG. 9B PRIOR ART
FIG. 9B is a cross-sectional view partially illustrating an exemplary developer container with a conventional edge seal.

Now, the reason for using the pile fabric is herein below described. That is, the reason for using the pile fabric 80*a* is as follows. An overlapping gap as a route of toner leakage from inside the developing unit to an outside is generally formed as shown in FIG. 9B. That is, each of the conventional edge seals 80 is composed of a single material such as felt, etc., and is brought in area contact with a circumferential surface of the developing roller at one end thereof at a given amount of pressure. Then, a tip of the entrance seal 90 enters the contact surface in which the conventional edge seal 80 is brought in area contact with the circumferential surface of the developing roller.

The entrance seal 90 has a thickness of about 0.3 mm, for example. Therefore, the edge seal 80 is crushed by an amount of depth corresponding to the thickness of the entrance seal 90. The edge seal 80 elastically restores its shape on the downstream side of it when passing through an overlapped section LAP in which the edge seal 80 overlaps with the tip of the entrance seal 90.

However, since a portion of the edge seal 80 immediately after the tip of the entrance seal 90 is in the middle of elastic recovery, the gap S corresponding to the thickness of the entrance seal 90 cannot be filled completely. Specifically, because the felt or the like is configured by a tightly intertwined fiber, an impact of crushing thereof by the tip of the entrance seal 90 ranges over a downstream side thereby causing the gap G there.

Then, according to this embodiment, to ease filling of the overlapping step created at the tip of the entrance seal 90, the one edge seal 80 is configured by multiple members constituting a laminate layer. Then, the most important member contacting the developing roller 36 is configured by the pile fabric 80*a* while bringing a strand pile section 80*a*1 of the pile fabric 80*a* in contact with a circumferential direction of the developing roller 36.

As shown in FIG. 8, each of the piles of the strand pile section 80*a*1 included in the pile fabric 80*a* is composed of an independent fiber. Accordingly, as shown in FIG. 9A, when the pile fabric 80*a* is used, the pile contacts the circumferential surface of the developing roller 36 without any gap. Therefore, the gap S created at the tip of the conventional entrance seal 90 as shown in FIG. 9B can be eliminated by the pile fabric 80*a* as shown in FIG. 9A, and accordingly, the toner leakage can be prevented.

In other words, as shown in FIG. 9A, the strand pile not overlapping with the entrance seal 90 on a downstream side of the downstream side tip of the entrance seal 90 is not affected by crushing made on the upstream side even at the nearest portion to the entrance seal 90 as a boundary. Therefore, the gap S shown in FIG. 9 B can be filled with the strand pile section 80*a*1, so that the gap is rarely created there. In this way, since the overlapping gap S is filled with the strand pile section 80*a*1, sealing performance is further improved more than that in the above-described embodiment that simply uses the toner damming section.

Now, the reason for using the elastic material is described herein below. That is, to effectively suppress an occurrence of the gap by using the pile fabric 80*a* as described above, a sealing pressure of the edge seal 80 applied to the developing roller 36 therefrom needs to be appropriately determined and set.

Specifically, as described above, since each of the pile fibers included in the pile fabric 80*a* is independent itself with a gap therebetween, a structure thereof inherently allows toner to easily enter the gap (i.e., inside the pile fabric 80*a*). Is general, although the higher the sealing pressure of the edge seal 80, the more improved the sealing performance, friction heat likely occur as a result due to its sliding contact with the developing roller 36. When the frictional heat is generated, toner near the edge seal 80 adheres to the edge seal 80, and causes either locking of the developing roller 36 or overload of torque, resulting in formation of an abnormal image. Therefore, an appropriate amount of sealing pressure needs to be determined and set.

However, since the strand pile section 80*a*1 of the pile fabric 80*a* is inflexible (or has poor flexibility), a range capable of properly setting a prescribed amount of sealing pressure is very narrow. Therefore, when the pile fabric 80*a* is used alone, since the sealing pressure is hardly set appropriately, the edge seal 80 is crushed too much sometimes, and accordingly the sealing pressure becomes too high.

By contrast, when a crushing amount of the edge seal 80 is not enough, the sealing pressure becomes too low, thereby causing the toner leakage again. In this way, the strand pile section 80*a*1 of the pile fabric 80*a* is sensitive to the sealing pressure.

Hence, instead of constituting the edge seal 80 only with the pile fabric 80*a*, a member having a prescribed appropriate cushioning performance (e.g., foamed polyurethane) is pasted onto the pile fabric 80*a* to facilitate and ensure setting of a prescribed appropriate amount of sealing pressure.

For example, even when the edge seal 80 is excessively crushed due to a variation in parts dimension, since the foamed polyurethane layer 80*b* as the elastic body, for example, is crushed, setting of excessive pressure can be prevented. In view of sealing performance of sealing for toner and a scraping degree of the developing roller 36 as well, the sealing pressure of the edge seal 80 is preferably set to from about 0.5 $N/cm^2$ to about 4.0 $N/cm^2$.

Now, the double-sided tape is herein below described more in detail. That is, a thickness of each of the double-sided tapes 80*c* and 80*d* used to paste the edge seal 80 is preferably from about 0.1 mm to about 0.2 mm as commonly used. However, the thickness of each of those double-sided tapes 80*c* and 80*d* is more preferably about 0.05 mm or less. The reason is that, since a surface of the development housing 31 onto which the edge seal 80 is pasted corresponds to an inner circumferential surface of the partially cylindrical section 31*b* extended along the shape of the developing roller 36, wrinkles likely appear on such an pasting surface when the double-sided tape is relatively thick, and as a result toner leaks from the wrinkles thereby raising a problem again.

Now, the entrance seal is herein below described more in detail. That is, the above-described entrance seal 90 is not necessarily electrically conductive and can employ a typical PET sheet or the like. Although whatsoever material is use as the entrance seal 90, the thickness of the entrance seal 90 is preferably about 0.3 mm or less to suppress the overlapping step at each of the ends thereof. Correspondingly, to fill the overlapping gap generated by the entrance seal 90 having the thickness like this, a length of strand pile section 80*a*1 (i.e., a pile length) physically needs at least about 0.3 mm as the minimum.

However, in case the thickness of the entrance seal 90 is about 0.3 mm, and the pile length of the strand pile section 80*a*1 is about 0.3 mm, the strand pile section 80*a*1 needs to be crushed by about 0.3 mm to fill the gap S created at the tip of the entrance seal 90. Thus, in a region in which it overlaps with the entrance seal 90 having the thickness of about 0.3 mm, the strand pile section 80*a*1 is crushed to have a length of substantially about 0 mm.

However, since a backside of the pile fabric 80*a* is configured by the foamed polyurethane layer 80*b*, rapid rising of the pressure is moderated somewhat even when the pressure is highly raised because the foamed polyurethane layer 80*b* is crushed at the same time. To further suppress the above-described rise in pressure, the pile length is desirably set to be at least twice as much as the thickness of the entrance seal 90, i.e., about 0.6 mm or more. Here, as the elastic material, any material other than the foamed polyurethane can be used as needless to described.

Now, a toner leakage test is herein below described in detail.

That is, FIG. 10 illustrates a result of toner leakage test executed by using five samples Nos. 1 to 5 prepared by using different materials or the like for the edge seal 80. In a chart of FIG. 10, absence of scattering indicates that scattering of toner from an edge of a developing roller is not recognized. Presence of scattering indicates that scattering of toner from the edge of the developing roller is recognized but it does not affect continuous operation and durability. Contamination of interior indicates that toner scattering from the edge of the developing roller contaminates an interior of an image forming apparatus and makes it difficult to continuously operate the image forming apparatus for a long time. Occurrence of adhesion indicates that toner adhesion occurs thereby locking the developing roller.

As shown, various specifications of respective samples Nos. 1 to 5 of the edge seals 80 are described in the chart.

A shape of the toner damming section used in the test is the same as that as described with reference to FIG. 5B (i.e., the second embodiment of the present invention). Specifically, the toner damming section 94, in which the inner edge 94*b* outwardly inclines from the rotation direction of the developing roller 36 by an angle of about θ2, is used. The angle θ2 is set to about 50° in this test. However, although the test is similarly executed by changing values within the range of θ2=50°±30°, no significant difference is observed therebetween.

As shown by this test result, when the No. 1 sample, specifically, with a linear entrance seal excluding toner damming sections 94 at respective ends as shown in FIG. 5B is used, scattering of toner is found already when the developing roller runs by a distance of about 3 km. By contrast, with the No. 2 sample having the toner damming sections 94 at respective ends, scattering of toner is not found even when the developing roller runs by a distance of about 15 km. From this, it is confirmed that the toner damming section effectively prevents the toner leakage, remarkably.

On the other hand, although the Nos. 2 to 3 samples similarly include the toner damming sections, respectively, in a test executed with the No. 3 sample having low sealing pressure (e.g., about 0.5 N/cm$^2$) due to felt as material of the edge seal, scattering of toner is found when the developing roller runs by a distance of about 6 km. With better contrast, in a test executed with the No. 2 sample having higher sealing pressure (e.g., about 2.0 N/cm$^2$), scattering of toner is not found even when the developing roller runs by a distance of about 15 km.

Also, it is confirmed that scattering of toner is not found at least until when the developing roller runs by a distance of about 9 km even when the No. 3 sample with low sealing pressure having caused the toner leakage at the distance of about 6 km is used if the strand pile is adopted in the edge seal thereof as in the No. 4 sample with the same low pressure.

Thus, it is confirmed that the edge seal employing the strand pile effectively prevents the toner leakage even at the low sealing pressure. By contrast, however, when the sealing pressure is too great (e.g., 5.0 N/cm$^2$) as in the No. 5 sample, it is found that the toner adheres in an early stage although no problem of sealing performance is raised. Hence, it is confirmed that a configuration, in which the edge seal composed of the pile fabric is brought in contact with the developing roller at a prescribed pressure from about 0.5 N/cm$^2$ to about 4.0 N/cm$^2$, effectively prevents the toner leakage.

Hereto fore, although as shapes of the toner damming sections 93 to 95 of the entrance seal 90, three types thereof are described, the shape allows various transformations as far as it includes a portion extending in the rotation direction of the developing roller.

Also, each of the toner damming sections 93 to 95 is not necessarily integrated with the same material with that of the entrance seal 90. That is, each of the toner damming sections 93 to 95 may be separately formed using identical or dissimilar material and is secured to the entrance seal 90 with adhesive or the like.

According to one embodiment of the present invention, at both ends of the entrance seal, a pair of toner damming sections is provided along edge seals while extending in a developing roller rotation direction with its inner edges inclining from the rotation direction of the developing roller, respectively. With this, the toner that tends to travel overlapping steps formed by the entrance seal and the edge seals and leaks outside the development housing can be likely reduced by the toner damming sections.

Further, the toner damming section is prone to creating burr or the like at an edge thereof during processing the entrance seal, and accordingly when the edge extends in a developing roller circumferential direction, the burr or the like of the edge tends to form a ring state linear groove on a circumferential surface of the developing roller. As a result, due to the linear groove, toner readily leaks.

However, according to one aspect of the present invention, since an inner edge of a toner damming section inclines from the rotation direction of the developing roller, generation of the linear groove in the circumferential direction of the developing roller, and accordingly, toner migrating along the linear groove can be effectively prevented.

That is, the sealing structure includes a housing to accommodate powder, a powder roller having a powder bearing surface to bear and convey the powder, and an entrance seal disposed between the powder roller and the housing. A pair of left and right edge seals is provided and respective one ends thereof in a circumferential direction of the powder roller overlap with outer circumferential surfaces of both ends of the entrance seal. The pair of left and right edge seals is fixed to the housing at respective one sides thereof while contacting circumferential surfaces of both ends of the powder roller at other sides thereof. Both ends of the entrance seal include powder damming sections extended in a rotation direction of the powder roller from both ends thereof along the pair of left and right edge seals, respectively. Multiple inner edges of the respective powder damming sections are each sandwiched between a corresponding one of the pair of left and right edge seals and the powder roller while substantially symmetrically inclining from the rotation direction of the powder roller.

According to another aspect of the present invention, generation of the linear groove in the circumferential direction of the powder roller, and accordingly, powder migrating along the linear groove can be more effectively prevented. That is, the inclining inner edges of the powder damming sections outwardly incline substantially symmetrically at both ends of the entrance seal from a rotation direction of the powder roller.

According to yet another aspect of the present invention, generation of the linear groove in the circumferential direction of the powder roller, and accordingly, powder migrating along the linear groove can be more effectively prevented. That is, the outwardly inclining inner edges of the powder damming sections extend beyond the powder roller in an axial direction of the powder roller, and tips of inclining inner edges of the respective powder damming sections do not overlap with the powder roller.

According to yet another aspect of the present invention, generation of the linear groove in the circumferential direction of the powder roller, and accordingly, powder migrating along the linear groove can be more effectively prevented. That is, the inclining inner edges of the powder damming sections inwardly incline substantially symmetrically at both ends of the entrance seal from a rotation direction of the powder roller.

According to yet another aspect of the present invention, generation of the linear groove in the circumferential direction of the powder roller, and accordingly, powder migrating along the linear groove can be more effectively prevented. That is, an upstream end of each of the inclining inner edges of the powder damming sections in the rotation direction of the powder roller is located between the inner edge of the edge seal and an outside end of the powder roller in an axial direction thereof.

According to yet another aspect of the present invention, generation of the linear groove in the circumferential direction of the powder roller, and accordingly, powder migrating along the linear groove can be more effectively prevented. That is, each of the edge seals is made of a pile fabric, wherein a strand side of the pile fabric is brought in contact with a circumferential surface of each of the ends of the powder roller at a prescribed pressure.

According to yet another aspect of the present invention, generation of the linear groove in the circumferential direction of the powder roller, and accordingly, powder migrating along the linear groove can be more effectively prevented. That is, a pile length of the pile fabric is from about 0.6 mm or more to about 3.0 mm or less.

According to yet another aspect of the present invention, generation of the linear groove in the circumferential direction of the powder roller, and accordingly, powder migrating along the linear groove can be more effectively prevented. That is, the edge seal composed of the pile fabric is brought in contact with the powder roller at a pressure of from about 0.5 $N/cm^2$ to about 4.0 $N/cm^2$.

According to yet another aspect of the present invention, generation of the linear groove in the circumferential direction of the powder roller, and accordingly, powder migrating along the linear groove can be more effectively prevented. That is, a base of the pile fabric is fixed to the housing through an elastic layer.

According to yet another aspect of the present invention, generation of the linear groove in the circumferential direction of the powder roller, and accordingly, powder migrating along the linear groove can be more effectively prevented. That is, the elastic layer is made of polyurethane foam.

According to yet another aspect of the present invention, in a developing device, generation of a linear groove in a circumferential direction of a developing roller, and accordingly, toner migrating along the linear groove can be effectively prevented. That is, the developing device includes the above-described sealing structure 1. In the sealing structure, the powder is toner, the housing is a development housing having a channel for toner stored in an interior thereof, and the powder roller is a developing roller rotatably disposed in the opening of the housing to bear and convey the toner on a circumferential surface of the developing roller. The entrance seal is disposed at an edge of the opening through which a circumferential surface of the developing roller passes and enters the development housing to allow the toner remaining on a circumferential surface of the developing roller to enter the development housing.

According to yet another aspect of the present invention, generation of the linear groove in the circumferential direction of the developing roller, and accordingly, toner migrating along the linear groove can be more effectively prevented. That is, the developing device further includes a toner layer regulating member at an edge of the opening to regulate a thickness of toner borne on a developer bearing circumferential surface of the developing roller.

According to yet another aspect of the present invention, in a cleaning device, generation of a linear groove in the circumferential direction of a rotatable elastic sanding roller, and accordingly, toner migrating along the linear groove can be effectively prevented. That is, the cleaning device includes the above-described sealing structure. In the sealing structure, the powder is toner scraped off from an image bearer, the housing is a cleaning housing to receive the toner, and the powder roller is the rotatable elastic sanding roller contacting the image bearer to convey the toner scraped off from the image bearer in the cleaning housing.

According to yet another aspect of the present invention, generation of the linear groove in the circumferential direction of the rotatable elastic sanding roller, and accordingly, toner migrating along the linear groove can be more effectively prevented. That is, the cleaning device further includes a cleaning blade installed in the cleaning housing to scrape off the toner from the surface of the image bearer.

According to yet another aspect of the present invention, in a process unit, generation of a linear groove in a circumferential direction of a powder roller, and accordingly, powder migrating along the linear groove can be effectively prevented. That is, a process unit includes the above-described sealing structure. The sealing structure includes a housing to accommodate powder, a powder roller having a powder bearing surface to bear and convey the powder, and an entrance seal disposed between the powder roller and the housing. A pair of left and right edge seals overlap with outer circumferential surfaces of both ends of the entrance seal at respective one ends thereof in a circumferential direction of the powder roller. The pair of left and right edge seals is fixed to the housing at respective one sides thereof while contacting circumferential surfaces of both ends of the powder roller at other sides thereof. Both ends of the entrance seal include powder damming sections extended in a rotation direction of the powder roller from both ends thereof along the pair of left and right edge seals, respectively. Multiple inner edges of the respective powder damming sections are each sandwiched between a corresponding one of the pair of left and right edge seals and the powder roller while substantially symmetrically inclining from the rotation direction of the powder roller.

Numerous additional modifications and variations of the present invention are possible in light of the above teachings. It is therefore to be understood that within the scope of the appended claims, the present invention may be executed otherwise than as specifically described herein. For example, the developing device and the cleaning unit are not limited to the above-described various embodiments and may be altered as appropriate.

What is claimed is:

1. A sealing structure comprising:

a housing to accommodate powder, having an opening;

a powder roller to bear and convey the powder;

an entrance seal disposed between the powder roller and a lower edge of the housing defining a lower edge of the opening, the entrance seal extending over an entire width of a lower edge of the housing in an axial direction of the powder roller; and a pair of left and right edge seals with respective one ends in a circumferential direction overlapping with outer circumferential surfaces of both axial ends of the entrance seal, the pair of left and right edge seals fixed to the housing at respective one sides thereof while contacting circumferential surfaces of both axial ends of the powder roller at other sides thereof, wherein both axial ends of the entrance seal include powder damming sections extended in a rotation direction of the powder roller along the pair of left and right edge seals, respectively, wherein inner edges of the respective powder damming sections are each sandwiched between a corresponding one of the pair of left and right edge seals and the powder roller while substantially symmetrically inclining from the rotation direction of the powder roller.

2. The sealing structure as claimed in claim 1, wherein the inner edges of the respective powder damming sections outwardly incline substantially symmetrically at both ends of the entrance seal from the rotation direction of the powder roller.

3. The sealing structure as claimed in claim 2, wherein the outwardly inclining inner edges of the respective powder damming sections extend beyond the powder roller in the axial direction of the powder roller, and tips of the inclining inner edges of the respective powder damming sections do not overlap with the powder roller.

4. The sealing structure as claimed in claim 1, wherein the inclining inner edges of the respective powder damming sections inwardly incline at both ends of the entrance seal from the rotation direction of the powder roller.

5. The sealing structure as claimed in claim 1, wherein an upstream end of each of the inclining inner edges of the respective powder damming sections in the rotation direction of the powder roller is located between an inner edge of the edge seal and an outside end of the powder roller in the axial direction thereof.

6. The sealing structure as claimed in claim 1, wherein each of the pair of left and right edge seals is made of a pile fabric, wherein a strand side of the pile fabric is brought in contact with a circumferential surface of each of the ends of the powder roller at a prescribed pressure.

7. The sealing structure as claimed in claim 6, wherein a pile length of the pile fabric is from about 0.6 mm or more to about 3.0 mm or less.

8. The sealing structure as claimed in claim 6, wherein each of the pair of left and right edge seals is composed of the pile fabric and is brought in contact with the powder roller at a prescribed pressure of from about 0.5 $N/cm^2$ to about 4.0 $N/cm^2$.

9. The sealing structure as claimed in claim 6, wherein a base of the pile fabric is fixed to the housing through an elastic layer.

10. The sealing structure as claimed in claim 9, wherein the elastic layer is made of polyurethane foam.

11. A developing device having the sealing structure as claimed in claim 1, wherein the powder is toner, the housing is a development housing to store toner in an interior thereof, the developer housing having an opening as a channel for the toner, the powder roller is a developing roller to bear and convey the toner on a circumferential surface of the developing roller, the developing roller rotatably disposed in the opening of the development housing, and the entrance seal is disposed at an edge of the opening through which the circumferential surface of the developing roller passes and enters the development housing to allow the toner remaining on the circumferential surface of the developing roller to enter the development housing.

12. The developing device as claimed in claim 11, further comprising a toner layer regulating member to regulate a thickness of toner borne on a developer bearing surface of the developing roller, the toner layer regulating member disposed at an edge of the opening.

13. A cleaning device having the sealing structure as claimed in claim 1, wherein the powder is toner scraped off from an image bearer, the housing is a cleaning housing to receive the toner, and the powder roller is a rotatable elastic sanding roller contacting the image bearer to convey the toner scraped off from the image bearer in the cleaning housing.

14. The cleaning device as claimed in claim 13, further comprising a cleaning blade installed in the cleaning housing to scrape off the toner from a surface of the image bearer.

15. A process unit with a sealing structure, the sealing structure comprising:

a housing to accommodate powder, having an opening;

a powder roller to bear and convey the powder;

an entrance seal disposed between the powder roller and a lower edge of the housing defining a lower end of the opening, the entrance seal extending over an entire width of a lower edge of the housing in an axial direction of the powder roller; and a pair of left and right edge seals with respective one ends in a circumferential direction overlapping with outer circumferential surfaces of both axial ends of the entrance seal, the pair of left and right edge seals fixed to the housing at respective one sides thereof while contacting circumferential surfaces of both axial ends of the powder roller at other sides thereof, wherein both axial ends of the entrance seal include powder damming sections extended in a rotation direction of the powder roller along the pair of left and right edge seals, respectively, wherein inner edges of the respective powder damming sections are each sandwiched between a corresponding one of the pair of left and right edge seals and the powder roller while substantially symmetrically inclining from the rotation direction of the powder roller.

16. An image forming apparatus with a sealing structure, the sealing structure comprising:

a housing to accommodate powder, having an opening;

a powder roller to bear and convey the powder;

an entrance seal disposed between the powder roller and a lower edge of the housing defining a lower end of the opening, the entrance seal extending over an entire width of a lower edge of the housing in an axial direction of the powder roller; and a pair of left and right edge seals with respective one ends in a circumferential direction overlapping with outer circumferential surfaces of both axial ends of the entrance seal, the pair of left and right edge seals fixed to the housing at respective one sides thereof while contacting circumferential surfaces of both axial ends of the powder roller at other sides thereof, wherein both axial ends of the entrance seal include powder damming sections extended in a rotation direction of the powder roller along the pair of left and right edge seals, respectively, wherein inner edges of the respective powder damming sections are each sandwiched between a corresponding one of the pair of left and right edge seals and the powder roller while substantially symmetrically inclining from the rotation direction of the powder roller.

17. The image forming apparatus as claimed in claim 16, wherein the inner edges of the respective powder damming sections outwardly incline substantially symmetrically at both ends of the entrance seal from the rotation direction of the powder roller.

18. The image forming apparatus as claimed in claim 17, wherein the outwardly inclining inner edges of the respective powder damming sections extend beyond the powder roller in the axial direction of the powder roller, and tips of the inclining inner edges of the respective powder damming sections do not overlap with the powder roller.

19. The image forming apparatus as claimed in claim 16, wherein the inclining inner edges of the respective powder damming sections inwardly incline at both ends of the entrance seal from the rotation direction of the powder roller.

20. The image forming apparatus as claimed in claim 16, wherein an upstream end of each of the inclining inner edges of the respective powder damming sections in the rotation direction of the powder roller is located between an inner edge of the edge seal and an outside end of the powder roller in the axial direction thereof.

21. The structure of claim 1, wherein the axial end portion of the powder roller includes a portion directly facing the entrance seal and a portion directly facing the edge seal.

22. The structure of claim 1, wherein each of the powder damming sections in both axial ends of the entrance seal includes a curved portion following a circumference of the powder roller and extending upward.

* * * * *